US006832133B1

(12) United States Patent
Belloli

(10) Patent No.: US 6,832,133 B1
(45) Date of Patent: Dec. 14, 2004

(54) METHOD AND PLANT FOR CONTINUOUSLY PRODUCING A BITUMINOUS CONGLOMERATE

(75) Inventor: Marco Belloli, Corsico (IT)

(73) Assignee: Bernardi Impianti International S.p.A. (IT)

( * ) Notice: Subject to any disclaimer, the term of this patent is extended or adjusted under 35 U.S.C. 154(b) by 394 days.

(21) Appl. No.: 10/089,472

(22) PCT Filed: Jun. 6, 2000

(86) PCT No.: PCT/EP00/05636

§ 371 (c)(1),
(2), (4) Date: Mar. 26, 2002

(87) PCT Pub. No.: WO01/25541

PCT Pub. Date: Apr. 12, 2001

(30) Foreign Application Priority Data

Oct. 1, 1999 (IT) ..... MI99A2046

(51) Int. Cl.[7] ..... G06F 19/00; B28C 7/04

(52) U.S. Cl. ..... 700/265; 700/117; 366/8; 366/18; 366/141

(58) Field of Search ..... 700/117, 265; 366/8, 16, 17, 18, 141, 152.1, 160.1

(56) References Cited

U.S. PATENT DOCUMENTS 4,218,145 A * 8/1980 Brock et al. ..... 366/18
4,812,047 A * 3/1989 Baumann ..... 366/141
5,873,653 A * 2/1999 Paetzold ..... 366/18
5,988,864 A * 11/1999 Bracegirdle ..... 366/7
6,036,353 A * 3/2000 Paetzold ..... 366/8
6,115,644 A * 9/2000 Petty et al. ..... 700/117

FOREIGN PATENT DOCUMENTS

EP 0397549 A * 11/1990 ..... G01N/5/00

* cited by examiner

*Primary Examiner*—Albert W. Paladini
*Assistant Examiner*—Douglas S. Lee
(74) *Attorney, Agent, or Firm*—Shlesinger & Fitzsimmons

(57) ABSTRACT

A method of producing, in a continuous plant, a bituminous conglomerate containing aggregates and at least bitumen comprises the steps of drying the aggregates and mixing them with a measured amount of at least the incoming bitumen to form the bituminous conglomerate; weighing the obtained bituminous conglomerate; calculating the amount of dry aggregates present in the conglomerate as the difference between the detected weight of the obtained bituminous conglomerate and the measured amount of at least bitumen; and adjusting in real time the amount of at least the incoming bitumen depending on the calculated amount of dry aggregates, so as to keep this bitumen amount within preestablished proportions with respect to the calculated amount of dry aggregates.

17 Claims, 1 Drawing Sheet

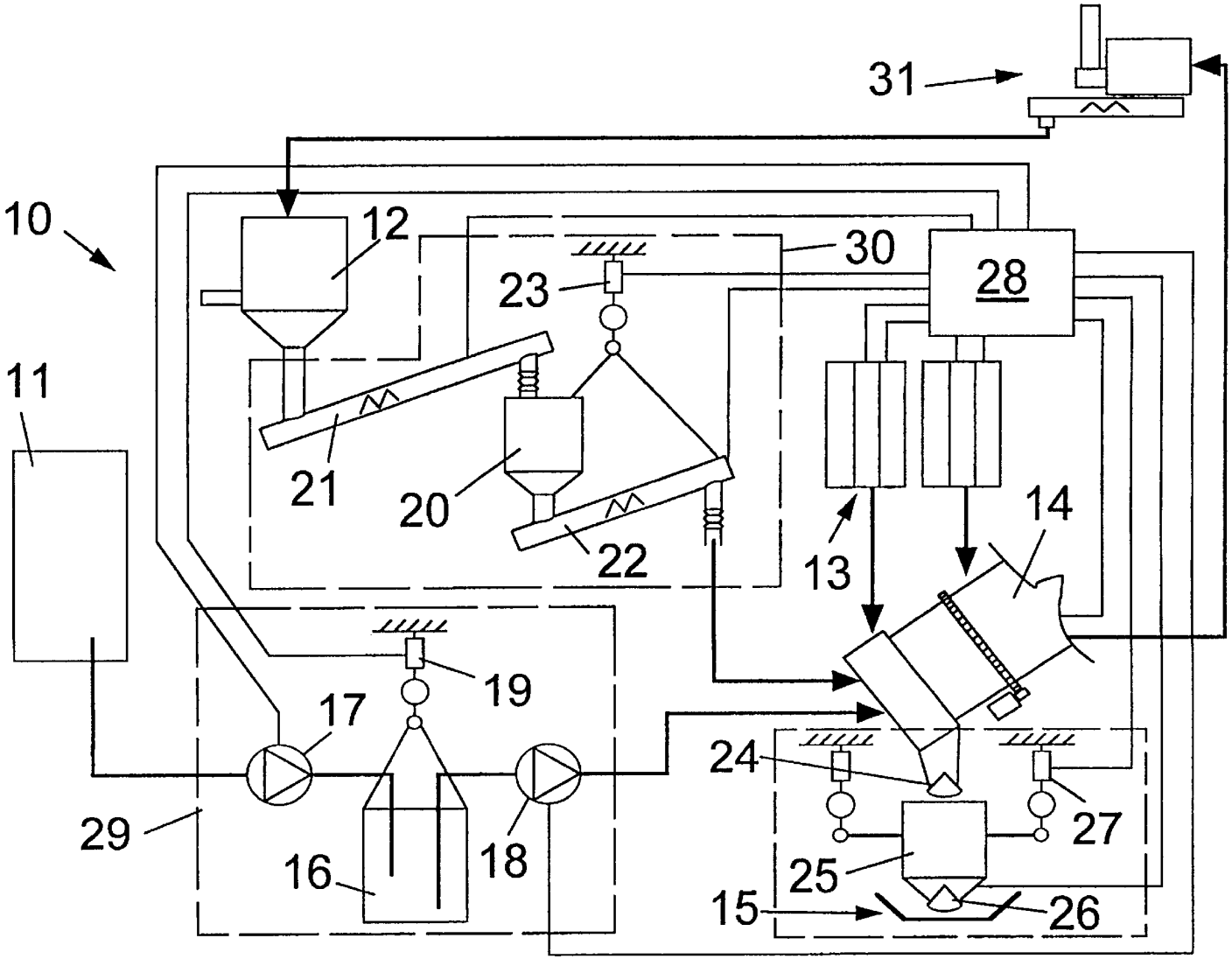
10
11
12
13
14
15
16
17
18
19
20
21
22
23
24
25
26
27
28
29
30
31

METHOD AND PLANT FOR CONTINUOUSLY PRODUCING A BITUMINOUS CONGLOMERATE

BACKGROUND AND SUMMARY

The present invention relates to an innovatory method and a plant applying such a method, for continuously producing a bituminous conglomerate in which exact proportions between the mixture components are adopted.

Known in the art of producing bituminous conglomerates is the importance of respecting precise "recipes" in the conglomerate composition. Tolerances in the recipes are usually limited; for instance, the bitumen percentage for each specific recipe is established with tolerances in the order of half a point percent and said tolerances for particular recipes can even be included between 0.05% and 0.08%.

By way of example, a typical recipe can be:

| Component | Value % | Tolerance % |
|---|---|---|
| (Dry) aggregate No. 1 | 45 | +/−5 |
| (Dry) aggregate No. 2 | 15 | +/−5 |
| (Dry) aggregate No. 3 | 15 | +/−5 |
| (Dry) aggregate No. 4 | 15 | +/−5 |
| Filler | 5 | +/−2 |
| Bitumen | 5 | +/−0.3 |

Unfortunately, aggregates are usually wet, having a moisture content generally included between 3% and 7%. For instance, typical humidity characteristics of the aggregates on the stocks can be:

| | Humidity value % |
|---|---|
| Aggregate No. 1 (sand) | 7 |
| Aggregate No. 2 (fine grit) | 4 |
| Aggregate No. 3 (medium grit) | 3.5 |
| Aggregate No. 4 (coarse grit) | 2 |

The moisture content in the aggregates as well as the filler content can vary depending both on the particle sizes and, more simply, on the they position take in the storage heap. In addition, it may easily happen that the moisture degree, in the same yard and for the same material, can vary even of some points percent, during the production of one and the same product.

The different and variable moisture percentages of the different components give rise, as a consequence, to calculation mistakes as regards the bitumen amount to be introduced into the mixture.

In order to solve this problem, use of an aggregate dryer as a unit separated from the mixer has been proposed, so as to eliminate humidity before picking up the established aggregate amounts as stated by the particular recipe.

The above introduces a complication in the plant and often there is a preference for plants in which the whole production process takes place within the drying oven to which both bitumen and damp aggregates are conveyed to be mixed together. In fact, these plants (named "Drum Dryer", "Drum Mixer", "CEM" plants, etc.) have the advantage that their purchase and use is not expensive. On the other hand, aggregates are necessarily weighed when wet (usually by a weighing conveyor belt) and, even if an attempt is made to carry out a compensation of the amounts by deducting the moisture percentage detected on a sample in a laboratory, the bitumen amount to be admitted to the mixture is only theoretically calculated and this leads to a non-eliminable and often high variability in the recipe as really applied. In addition to the above, the natural filler amount present in the aggregates and resulting from the crushing process can very widely vary in percentages, ranging from 2–3% to 20–25%, from yard to yard but also in the same yard (for instance, when the aggregates do not come from the same source and/or are produced with ores of different qualities and/or qualities varying in time). This variability depends on the ore nature, since the ore can be more or less hard and friable, and also on the type of crusher used and, above all, on the presence or not of the step of washing the aggregates with water after crushing. Carrying out washing of the aggregates or not, so as to practically eliminate all excess filler, depends on technical or economical choices (if lack of water exists or the water supply is difficult, for example).

Since the filler amount required in the recipe is precise, when the filler amount present in the aggregates is too much, part of it will have to be necessarily discarded. Usually the filler carried along by the gases coming out of the oven reaches an appropriate filter. This therefore takes place downstream of weighing, which operation is carried out on the conveyor belt. At all events, the recovered filler is introduced into the mixing region by means of metering screws having a controlled number of revolutions to carry out a volumetric dosage. As a result, if there is an excess amount of filler, which happens very often, no control exists as regards the discarded amount and the statistical determination of this filler amount relies on laboratory tests.

In conclusion, the evaluation errors on the exact amount of bitumen to be introduced into the oven depend on the above estimate that, although precise, introduces an uncertainty degree into the recipe.

It is a general object of the present invention to obviate the above mentioned drawbacks by providing a production method and plant enabling a bituminous conglomerate to be continuously produced, with high precision and constancy in respecting the "recipe".

In view of this aim, in accordance with the invention a method has been devised for production, in a continuous plant, of a bituminous conglomerate containing aggregates and at least bitumen, which method comprises the steps of drying the aggregates and mixing them with a measured amount of incoming bitumen to form the bituminous conglomerate; weighing the obtained bituminous conglomerate; calculating the amount of dry aggregates present in the conglomerate as the difference between the detected weight of the obtained bituminous conglomerate and said measured amount of bitumen; adjusting in real time at least the amount of incoming bitumen depending on the calculated amount of dry aggregates, so as to keep this bitumen amount within preestablished proportions with respect to the calculated amount of dry aggregates.

Still in accordance with the present invention, a continuous plant for producing bituminous conglomerate has been also devised which comprises a drier-mixer unit to which feed means sends aggregates and at least bitumen so as to form the bituminous conglomerate, characterised in that it comprises means for measuring the amounts of bitumen sent to the drier-mixer unit, means for weighing the bituminous conglomerate coming out of the unit, and a control system calculating the amount of dry aggregates present in the outgoing conglomerate as the difference between the weight of the bituminous conglomerate detected by the weighing means and the amounts of bitumen detected by the means for measuring said amounts, the control system operating the bitumen feed means so as to adjust in real time at least the amount of bitumen entering the unit, depending on the calculated amount of dry aggregates, so as to keep this bitumen amount within preestablished proportions with respect to the calculated amount of dry aggregates.

BRIEF DESCRIPTION OF THE DRAWING

The only FIGURE is a diagramatic representation of a plant in accordance with the invention.

DETAILED DESCRIPTION OF THE INVENTION

For better explaining the innovatory principles of the present invention and the advantages it offers over the known art, a possible embodiment of the invention applying these principles will be described hereinafter, by way of example, with the aid of the accompanying drawing in which the only FIGURE is a diagrammatic representation of a plant in accordance with the invention.

With reference to the FIGURE, a plant, generally identified by 10, comprises a bitumen deposit generally denoted by 11, a filler deposit 12 and a supply of aggregates or inert materials, sent from known feeders 13 that can be easily envisaged by a person skilled in the art.

Bitumen, filler and aggregates are mixed in a unit 14 consisting of a drier and a mixer from which the bituminous conglomerate exits through a controlled discharge outlet 24. Known collection and transportation means 15 evacuates the finished product. The filler contained in the aggregates is carried along by the fumes to a recovery plant 31 evacuating the combustion gases and water vapour and recovering the filler by a known filter sending it to container 12 (possibly provided with means for evacuating the excess filler), so that it will be utilised again in the production process.

Bitumen is conveyed to the unit by controlled-feed means 29, the filler being conveyed to the unit by controlled-feed means 30.

Downstream of the controlled discharge outlet 24 of the product from unit 14 there is a hopper 25 having a controlled discharge opening 26 that upon command releases the product into the transportation means 15. This hopper 25 is provided with weighing means 27, load cells for example.

The described plant is provided with a control system 28 (a suitably programmed computer, for example).

The drier-mixer unit can be embodied by a known rotary oven or kiln as shown in the FIGURE, or by a known mixer and a known oven separated from each other, the drying oven discharging into the mixer. In both cases it is advantageous that a mixing region and a drying region should be defined and that to the mixing region at least bitumen and the possible filler should be fed, the aggregates being instead fed to the drying region.

During operation of the plant, first a speed is set for aggregate extraction (wet aggregates having an unknown and only presumed real humidity) from the respective feeders 13, depending on the theoretically required individual percentage. In addition setting of the theoretical bitumen percentage requested in the recipe is carried out. The same is done for the filler (if any) and possible other components (not shown or described, as they can be easily envisaged by a person skilled in the art).

The aggregates, through normal transportation means, reach the dryer and travel along it until they reach the discharge region 24. Bitumen and filler are, for the moment, fed to the foreseen feed regions of the unit in an amount proportional to the theoretical percentage provided by the particular recipe to be applied and to the amount of aggregates extracted from feeders 13.

First the discharge outlet 24 is open and the discharge opening 26 is closed; the finished product coming out of unit 14 is thus accumulated in the weighing hopper 25 and the weighing system begins to register the weight (or best, the weight increase) of the outlet hopper 25.

After a short period of stabilisation, the control system 28 draws the net weight of the aggregates based on the weight increase in time of hopper 25 after deducing the amount of bitumen and of the other additives added to the conglomerate. With a continuous modality or following short-time sequences, the weight value of the (dry) aggregates thus obtained is employed by the control system to adjust at least the infed bitumen amount, so that the desired recipe is respected. Substantially, bitumen is metered in real time depending on the calculated weight of the dry aggregates.

As time goes by, the outlet hopper 25 reaches the maximum weight allowed by its volume; the control system therefore closes door 24 and stops the continuous control of the bitumen amount. Admission of the various components goes on depending on the last value calculated. Door 26 is opened and the outlet hopper 25 contents are discharged into the transportation means 15.

Upon a signal that the hopper is empty, system 28 closes door 26 and subsequently opens door 24 again, waits for weight stabilisation and restarts the continuous metering control of the elements as above described. The described cycle can be repeated over the whole desired production time.

The bitumen feed means 29 could be accomplished following known systems, such as a mere positive-displacement pump possibly provided with a liter-counter. However due to temperature variations in bitumen, measurement errors could be introduced.

In order to further improve precision in carrying out the recipe, still in accordance with the principles of the present invention, more precise and reliable feed means is proposed. This means implements a plant denoted by 29 for weighed feed of bitumen. Said means comprises a hopper 16, disposed between the bitumen deposit 11 and unit 14. Bitumen is fed to the intermediate hopper 16 by a filling pump 17 dipping into deposit 11, and is picked up from hopper 16 by a drawing pump 18 sending bitumen to unit 14. Hopper 16 is provided with weighing means 19, load cells for example. Before the plant starting, pump 17 fills the intermediate hopper 16 and then stops. When the plant has been started, pump 18, a variable delivery pump, dips into hopper 16 and admits bitumen to unit 14 in an amount provided by the recipe. Once reading in hopper 25 has been stabilised, weight decreasing in time in hopper 16 will be proportional to the real amount of dry aggregates as calculated by the control system 28 and this will enable the control system 28 to carry out the feedback adjustment of the picked-up amount of pump 18 to ensure introduction of bitumen into the unit 14 in the desired exact amount based on the calculated weight of dry aggregates.

Necessarily, at a certain point hopper 16 reaches a minimum weight value and the filling pump 17 is started again. While pump 17 is, in a short period of time, restoring the weight corresponding to the maximum level in hopper 16 the speed of pump 18 is kept constant, fixed to the last value adjusted, the feedback control being temporarily stopped. When filling of hopper 16 has been completed, the "fed-back" bitumen-feeding procedure starts again as above described. For more precision in the system, the filling step of the intermediate hopper 16 can be made to coincide with the discharge step of the outlet hopper 25.

The filler feed means too (as well as the feed means for the other components) may comprise a weighing system, in the same manner as done for bitumen.

In order to carry out the above, as shown in the FIGURE, an intermediate hopper 20 is present between the filler deposit 12 and unit 14 and the filler is conveyed to this hopper by a screw conveyor 21 and picked up therefrom by a screw conveyor 22. In the same manner as the bitumen hopper, the filler hopper 20 is provided with weighing means, denoted by 23, load cells for example.

Operation of plant 30 for weighed feed of filler corresponds to the above description relating to plant 29 for weighed feed of bitumen. First the screw conveyor 21 fills hopper 20 with filler. The filler is then fed to unit 14 by the screw conveyor 22 moved by a controlled-and-variable-speed motor, while system 28 is measuring the weight decrease of the hopper thereby carrying out a feedback adjustment of the operation of the screw conveyor 22. When hopper 20 reaches its minimum weight, the feedback control of the screw conveyor 22 is momentarily stopped, the screw conveyor 22 goes on carrying out feeding of filler in a constant manner, while the screw conveyor 21 is restarted to fill the hopper again and quickly, until its maximum contents.

At this point it is apparent that the intended purposes have been achieved by eliminating the "humidity" variable and, if necessary, the "filler percentage" variable from the production process (without being obliged, on the other hand, to dry and eliminate the filler from the aggregates before the latter are measured) and that a high precision in executing the desired recipe has been reached.

It is apparent that possible errors in a plant in accordance with the invention can be only ascribed to the precision in the static weighing instruments and not (as in the plants of the known art) to the correspondence between the contents estimations as regards humidity and filler and the real humidity and filler contents in the aggregates. With the above described system for weighing the incoming bitumen, also eliminated are errors due to variations in the specific gravity of bitumen depending on temperature. By way of example, technical errors and evaluation errors that can be found in a plant of the known art can be summarised as follows (an estimate of the value percent of the errors in the best case is given into brackets): evaluation error in the inert material humidity, therefore in the inert-material loss of weight during the drying step (2%); errors due to a non-correct feed of the individual aggregate fractions and influence of same on calculation of the loss of weight during the drying step, taking into account their different starting humidity content (0.2%); weighing errors for the aggregates introduced into the dryer, due to defects present on the weighing conveyor belt mat (1%), due to the wind push on the weighing conveyor belt (2%), due to materials stuck on the weighing conveyor belt mat (1%); errors due to discarding of the excess filler already weighed on the weighing conveyor belt (2%); errors on the volumetric dosage of bitumen due to varying of the specific gravity as there is a temperature variation (0.5%).

All the above errors (that on the whole give error percentages in the order of 10%) are completely eliminated with the plant and method of the present invention.

On the other hand, the weighing errors of the finished product, bitumen and filler that may arise in a plant in accordance with the invention can be easily maintained each within a percentage of 0.2%.

Obviously, the above description of an embodiment applying the innovatory principles of the present invention is given by way of example only and therefore must not be considered as a limitation of the scope of the patent rights as claimed in the appended claims.

For instance, other weighing means can be adopted depending on specific requirements. In addition, because the lower tolerances in the recipe generally are in the bitumen amount, one can choose to only carry out a feedback adjustment of the amount of bitumen supplied to the unit inlet, depending on the calculated weight of the dry aggregates.

I claim:

1. A method of producing, in a continuous plant, a bituminous conglomerate containing aggregates and at least bitumen, comprising the steps of:

drying the aggregates and mixing them with a measured amount of incoming bitumen to form the bituminous conglomerate;

weighing the obtained bituminous conglomerate;

calculating the amount of dry aggregates present in the conglomerate as the difference between the detected weight of the obtained bituminous conglomerate and said measured amount of bitumen;

adjusting in real time at least the amount of incoming bitumen depending on the calculated amount of dry aggregates, so as to keep this bitumen amount within preestablished proportions with respect to the calculated amount of dry aggregates.

2. A method as claimed in claim 1, wherein a filler is added to the bituminous conglomerate.

3. A method as claimed in claim 1, wherein measurement of the incoming bitumen amount is obtained through measurement in real time of the weight reduction of a container from which bitumen is taken up.

4. A method as claimed in claim 2, wherein measurement of the filler amount is obtained through measurement in real time of the weight reduction of a container from which filler is taken up.

5. A method as claimed in claim 2, wherein filler, bitumen and aggregates are mixed in a drier-mixer unit comprising a mixer and an oven.

6. A method as claimed in claim 5, wherein the fumes coming out of the oven are filtered to recover excess filler which is stored for possible reuse of same in the production process.

7. A continuous plant for producing a bituminous conglomerate containing aggregates and at least bitumen, comprising a drier-mixer unit (14) to which feed means (13, 18, 22) sends bitumen and aggregates so as to form the bituminous conglomerate, characterised in that it comprises means (29, 30) for measuring the amounts of bitumen sent to the drier-mixer unit, means (25, 27) for weighing the bituminous conglomerate coming out of the unit, and a control system (28) calculating the amount of dry aggregates present in the outgoing conglomerate as the difference between the weight of the bituminous conglomerate detected by the weighing means (25, 27) and the amounts of bitumen detected by the means (29, 30) for measuring said amounts, the control system operating the bitumen feed means (18, 22) so as to adjust in real time at least the amount of bitumen entering the unit (14), depending on the calculated amount of dry aggregates, so as to keep this bitumen amount within preestablished proportions with respect to the calculated amount of dry aggregates.

8. A plant as claimed in claim 7, characterised in that the conglomerate weighing means comprises a hopper (25) provided with weighing sensors (27) and in which the drier-mixer unit (14) carries out the conglomerate discharge.

9. A plant as claimed in claim 7, characterised in that the means measuring the bitumen amount sent to the drier-mixer unit comprises a hopper (16) with weight-detecting sensors (19) from which bitumen is taken up by said bitumen feed means (18) to be sent to the drier-mixer unit (14), further bitumen feed means (17) being present for controlled filling of said hopper (16) with bitumen taken up from a bitumen deposit (11).

10. A plant as claimed in claim 9, characterised in that said bitumen feed means comprises a sucking pump (18) to draw bitumen from the hopper (16).

11. A plant as claimed in claim 9, characterised in that the weight-detecting sensors comprise load cells (19) from which the bitumen hopper (16) is suspended.

12. A plant as claimed in claim 7, characterised in that it comprises means for measured addition of filler to the bitumen.

13. A plant as claimed in claim 12, characterised in that the means for filler addition comprises a hopper (20) provided with weight-detecting sensors (23) and from which the filler is taken up by filler feed means (22) to be sent to the drier-mixer unit (14), further filler feed means (21) being present for controlled filling of said hopper (20) with filler picked up from a filler deposit (12).

14. A plant as claimed in claim 13, characterised in that said feed means comprises a screw conveyor (22) to pick up the filler from the hopper (20).

15. A plant as claimed in claim 13, characterised in that said weight-detecting sensors comprise load cells (23) from which the filler hopper (20) is suspended.

16. A plant as claimed in claim 12, characterised in that the fumes coming out of the drier-mixer unit (14) are caused to pass through a filtering plant (31) recovering the excess filler carried along by said fumes and sending it to a filler deposit (12) for reuse of said filler.

17. A plant as claimed in claim 7, characterised in that the drier-mixer unit comprises a drying region and a mixing region, the aggregates being fed to the unit by introduction into the drying region and the bitumen and possible filler being fed to the unit by introduction into the mixing region.

* * * * *